US010436223B2

(12) United States Patent
Lee et al.

(10) Patent No.: US 10,436,223 B2
(45) Date of Patent: Oct. 8, 2019

(54) FAN

(71) Applicant: DELTA ELECTRONICS, INC., Taoyuan (TW)

(72) Inventors: Tsung-Ying Lee, Taoyuan (TW); Shih-Han Chen, Taoyuan (TW); Chao-Wen Lu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 486 days.

(21) Appl. No.: 14/665,811

(22) Filed: Mar. 23, 2015

(65) Prior Publication Data

US 2015/0267715 A1 Sep. 24, 2015

Related U.S. Application Data

(60) Provisional application No. 61/969,384, filed on Mar. 24, 2014.

(51) Int. Cl.
*F04D 29/66* (2006.01)
*F04D 17/04* (2006.01)
(Continued)

(52) U.S. Cl.
CPC ..... *F04D 29/661* (2013.01); *F04D 17/04* (2013.01); *F04D 25/0613* (2013.01);
(Continued)

(58) Field of Classification Search
CPC .... F04D 29/661; F04D 29/663; F04D 29/281; F04D 29/282; F04D 29/30;
(Continued)

(56) References Cited

U.S. PATENT DOCUMENTS 4,639,193 A * 1/1987 Reichert ..... F04D 29/281 416/134 R
4,958,504 A * 9/1990 Ichikawa ..... B60H 1/247 165/122
(Continued)

FOREIGN PATENT DOCUMENTS

CN 101994707 A 3/2011
CN 102213236 A 10/2011
(Continued)

*Primary Examiner* — Christopher Verdier

(74) *Attorney, Agent, or Firm* — Muncy, Geissler, Olds & Lowe, P.C.

(57) ABSTRACT

A fan includes a fan frame and a rotor having a hub, a shaft connected with the hub at its rotation center, blades, and a disk structure connected with the blades and hub within the fan frame. The fan frame has a frame wall having inlet and outlet surfaces, a base carrying the rotor and frame wall, a cover on one side of the frame wall opposite to the base, and a tongue structure between the base and cover. The normal lines of the inlet and outlet surfaces are not parallel to the extension direction of the shaft. The distance between the virtual line segment of the outlet surface and shaft is the shortest distance between the shaft and outlet surface. The extended line from the center of the groove opening of the tongue structure intersects the imaginary plane where the virtual line segment and shaft are located.

6 Claims, 12 Drawing Sheets

(51) Int. Cl.
*F04D 29/28* (2006.01)
*F04D 29/30* (2006.01)
*F04D 29/42* (2006.01)
*F04D 25/06* (2006.01)

(52) U.S. Cl.
CPC ..... *F04D 29/281* (2013.01); *F04D 29/30* (2013.01); *F04D 29/422* (2013.01); *F04D 29/4226* (2013.01); *F04D 29/663* (2013.01)

(58) Field of Classification Search
CPC .... F04D 29/4226; F04D 29/422; F04D 17/04; F04D 25/0613
USPC ..... 415/53.1–53.3
See application file for complete search history.

(56) References Cited

U.S. PATENT DOCUMENTS 6,111,748 A 8/2000 Bhatia
6,158,954 A * 12/2000 Nabeshima ..... F04D 29/283 415/119
6,692,223 B2 * 2/2004 Ikeda ..... F04D 17/04 165/122
8,534,998 B2 9/2013 Liang et al.
2003/0063976 A1 * 4/2003 Horng ..... F04D 29/282 416/183
2006/0099071 A1 5/2006 Kao et al.
2006/0269416 A1 * 11/2006 Wu ..... F04D 29/662 416/219 R
2007/0116576 A1 * 5/2007 Chang ..... F04D 29/281 416/228
2011/0250065 A1 10/2011 Liang et al.
2013/0343874 A1 * 12/2013 Li ..... F04D 29/58 415/116

FOREIGN PATENT DOCUMENTS

TW 463082 B 11/2001
TW 200615459 5/2006
WO WO 98/52397 1/1998

* cited by examiner

FAN

CROSS REFERENCE TO RELATED APPLICATIONS

This Non-provisional application claims priority to U.S. provisional patent application with Ser. No. 61/969,384 filed on Mar. 24, 2014. This and all other extrinsic materials discussed herein are incorporated by reference in their entirety.

BACKGROUND

Technical Field

The invention relates to a fan, in particular to a cross flow fan.

Related Art

As technology rapidly developed, the performance of electronic devices has been improved at every moment. However, if the heat generated by the electronic device is not properly dissipated, it will lead to deterioration of efficiency and even cause the electronic device to be burned. Therefore, the cooling device is an indispensable equipment for electronic devices.

As the current electronic devices are developed to be thinner, the heat sink of the small size becomes more important. The CFF (Cross flow fan) which is different from the axial fan air and its flow path is more appropriate for the flat and thin cooling space.

However, the design of the flow channel of the existing cross flow fan is inferior, there is too much ineffective space within the fan. It results in that the air can not flow smoothly thus being stuck in the fan. Therefore, its blowing rate is deficient, and the overall fan utilization rate is low.

SUMMARY

A fan according to the invention includes a rotor and a fan frame. The rotor has a shaft, a plurality of blades, a hub and a disk structure. The disk structure is connected with the blades and the hub, and the shaft is connected to the hub and located at the rotation center of the hub. The rotor is disposed within the fan frame. The fan frame has a frame wall, a base, a cover and a tongue structure. The frame wall has an inlet surface and an outlet surface. The normal lines of the inlet surface and the outlet surface are not parallel to the extension direction of the shaft. The base carries the rotor and the frame wall. The cover is disposed on one side of the frame wall opposite to the base. The tongue structure is disposed between the base and the cover and it has a groove. The outlet surface has a virtual line segment. The distance between the virtual line segment and the shaft is the shortest distance between the shaft and the outlet surface. The virtual line segment and the shaft are located on an imaginary plane, and the extended line from the center of the opening of the groove intersects the imaginary plane.

In one embodiment, the inclination angle of the blades with respect to the shaft is between 5° to 50°.

In one embodiment, a plurality of ribs are formed within the disk structure, and an included angle between the extensions of the adjacent ribs is between 9° to 18°.

In one embodiment, the width of the inlet surface is wider than the width of the outlet surface.

A fan according to the invention includes a rotor, a fan frame and a partition structure. The rotor has a shaft, a plurality of blades, a hub and a disk structure. The disk structure is connected with the blades and the hub. The shaft is connected to the hub and located at the rotation center of the hub. The rotor is disposed within the fan frame. The fan frame has a frame wall, a base and a cover. The frame wall has an inlet surface and an outlet surface. The normal lines of the inlet surface and the outlet surface are not parallel to the extension direction of the shaft. The base carries the rotor and the frame wall. The cover is disposed on one side of the frame wall opposite to the base. The partition structure is disposed between the blades and the inner wall surface of the frame wall.

In one embodiment, the height of the partition structure is higher than or equal to half the height of the frame wall.

In one embodiment, the partition structure is connected with the base or the cover.

In one embodiment, the inclination angle of the blades with respect to the shaft is between 5° to 50°.

In one embodiment, a plurality of ribs are formed within the disk structure, and an included angle between the extensions of the adjacent ribs is between 9° to 18°.

In one embodiment, the width of the inlet surface is wider than the width of the outlet surface.

In one embodiment, the fan frame further includes a tongue structure having a groove. The outlet surface has a virtual line segment. The distance between the virtual line segment and the shaft is the shortest distance between the shaft and the outlet surface. The virtual line segment and the shaft are located on an imaginary plane, and the extended line from the center of the opening of the groove intersects the imaginary plane.

A fan according to the invention includes a rotor, a fan frame and a flow block structure. The rotor has a shaft, a plurality of blades, a hub and a disk structure. The disk structure is connected with the blades and the hub. The shaft is connected to the hub and located at the rotation center of the hub. The rotor is disposed within the fan frame. The fan frame has a frame wall, a base and a cover. The frame wall has an inlet surface and an outlet surface. The normal lines of the inlet surface and the outlet surface are not parallel to the extension direction of the shaft. The base carries the rotor and the frame wall. The cover is disposed on one side of the frame wall opposite to the base. The flow block structure is disposed between inlet surface and the shaft.

In one embodiment, the flow block structure is located between the shaft and the blades.

In one embodiment, the fan frame further includes a tongue structure having a groove. The outlet surface has a virtual line segment. The distance between the virtual line segment and the shaft is the shortest distance between the shaft and the outlet surface. The virtual line segment and the shaft are located on an imaginary plane. The extended line from the center of the opening of the groove intersects the imaginary plane.

In one embodiment, the fan further includes a partition structure disposed between the blades and the inner wall surface of the frame wall.

In one embodiment, the flow block structure is connected with the base, the height of the flow block structure is larger than or equal to half the distance between the base and the disk structure, and the height is smaller than the distance between the base and the disk structure.

In one embodiment, the flow block structure is connected with the cover, the height of the flow block structure is larger than or equal to half the distance between the cover and the disk structure, and the height is smaller than the distance between the cover and the disk structure.

In one embodiment, the inclination angle of the blades with respect to the shaft is between 5° to 50°.

In one embodiment, a plurality of ribs are formed within the disk structure, and an included angle between the extensions of the adjacent ribs is between 9° to 18°.

In one embodiment, the width of the inlet surface is wider than the width of the outlet surface.

As mentioned above, because the fan utilizes the design of the tongue structure having the groove, the air flowing to the groove will produce turbulence. Thus an air wall is formed between the groove and the adjacent outer edge of the blades so as to effectively reduce the space which the air passes between the tongue structure and the outer edge of the blades in the flow channel, and then the noise is significantly reduced. On the other side, on the condition of producing the same level noise, the rotational speed of the fan in the embodiment is further increased so as to raise the volume flow rate. In other embodiments, the fan may include the partition structure and the flow block structure. Thus, when the rotor rotates and the blades accordingly drive the air to enter the outer flow channel and the inner flow channel from the inlet surface, partial air flow flowing into the inner flow channel is reflected by the partition structure and then enters the rotation range of the blades again. In the meanwhile, because the air flowing across the disk structure is blocked by the flow block structure, it will flow to the blades and then be taken to the outlet surface. Thus, the detained air in the fan can be reduced and the effective outlet volume flow rate is enhanced.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1A:
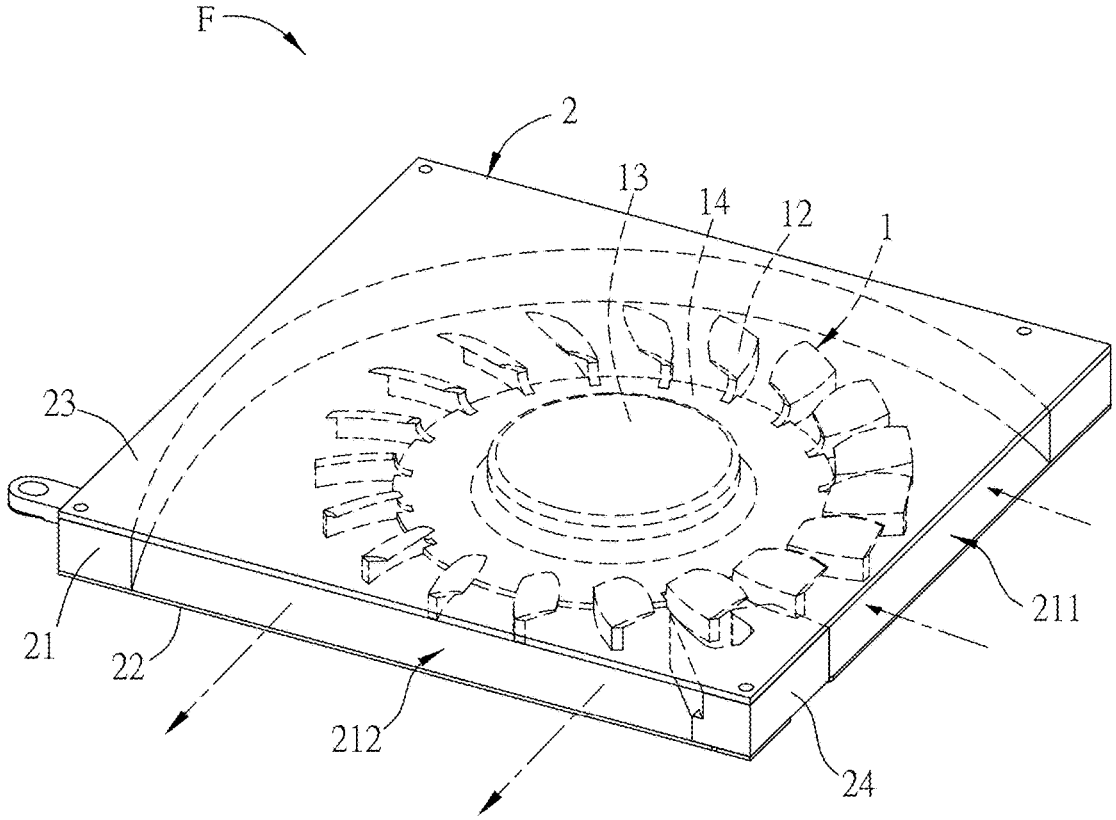
FIG. 1A is a perspective view showing the exterior of a fan according to the first embodiment of the invention.
Figure 1B:
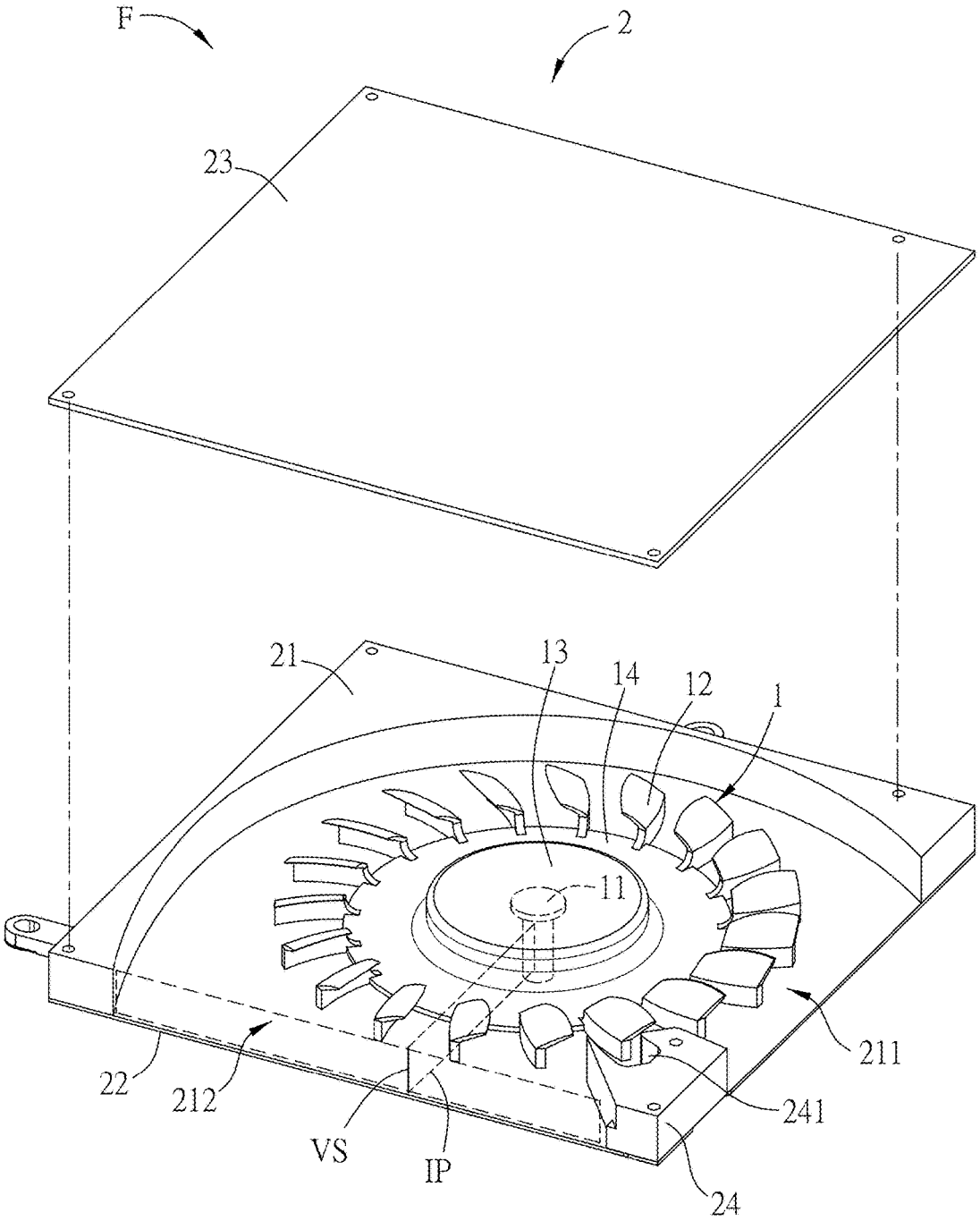
FIG. 1B is an exploded perspective view showing the fan of FIG. 1A.
Figure 1C:
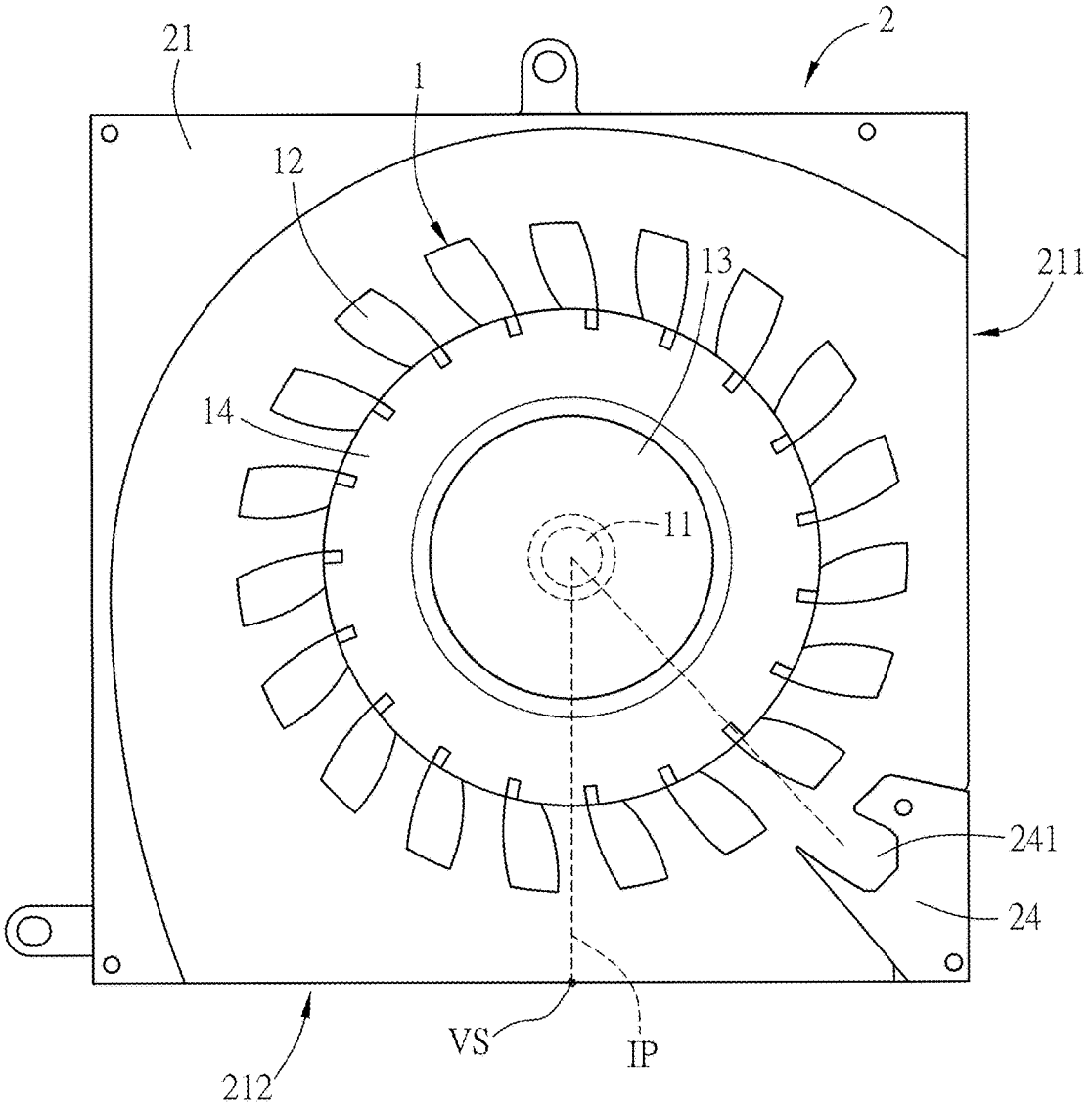
FIG. 1C is a top view showing the fan of FIG. 1B.

FIG. 1A is a perspective view showing the exterior of a fan according to the first embodiment of the invention. FIG. 1B is an exploded perspective view showing the fan of FIG. 1A. FIG. 1C is a top view showing the fan of FIG. 1B. For conveniently illustrating the fan, the cover is not shown in FIG. 1C. Referring to FIG. 1A, FIG. 1B and FIG. 1C, a fan F includes a rotor 1 and a fan frame 2. The rotor 1 is disposed within the fan frame 2. The rotor 1 has a shaft 11, a plurality of blades 12, a hub 13 and a disk structure 14. The disk structure 14 is connected with the blades 12 and the hub 13. The hub is located at the center of the disk structure 14. The blades are connected to the outer of the disk structure 14 and arranged circularly. The shaft 11 is connected to the hub 13 and located at the rotation center of the hub 13. In addition, the rotor 1 may include a rotor magnetic set, bushings, wearable pieces, and/or thrust piece, etc. within the hub. Because their connection and function are well known, they are not particularly illustrated here.

In the embodiment, the fan frame 2 has a frame wall 21, a base 22, a cover 23 and a tongue structure 24. The frame wall 21 is approximately a square structure, and it has an inlet surface 211 and an outlet surface 212. The normal lines of the inlet surface 211 and the outlet surface 212 are not parallel to the extension direction of the shaft 11, namely the fan F is a CFF (cross flow fan). In the embodiment, the inlet surface 211 and the outlet surface 212 are two adjacent surfaces. In other embodiments, the inlet surface 211 and the outlet surface 212 may be two opposite surfaces. Besides, the width of the inlet surface 211 is wider than the width of the outlet surface 212 so as to raise wind pressure. Therefore, the performance of fan F is improved.

The base 22 carries the rotor 1 and the frame wall 21. The cover 23 is disposed on one side of the frame wall 21 opposite to the base 22. Namely, the frame wall 21 and the rotor 1 are located between the base 22 and the cover 23. In addition, the base 22 and the cover 22 may be flat plate, and additional broken holes may be disposed on the base 22 and the cover 23 to raise the inlet volume flow rate. In the embodiment, it takes no broken hole for example.

The tongue structure 24 is disposed between the base 22 and the cover 23 and the tongue structure 24 has a groove 241. The groove 241 communicates with the flow channel of the fan F. The axial depth of the groove 241 may be smaller than or equal to the height of the tongue structure 24. In addition, the shape of the groove 241 is not limited here, and the dimension of the groove is not limited, too.

The outlet surface 212 has a virtual line segment VS. The distance between the virtual line segment VS and the shaft 11 is the shortest distance between the shaft 11 and the outlet surface 212, namely the virtual line segment VS is parallel to the shaft 11. The virtual line segment VS and the shaft are located on an imaginary plane IP. The imaginary plane IP is collectively constituted by the virtual line segment VS, the cover 23, the shaft 11 and the base 22. The extended line from the center of the opening of the groove 241 intersects the imaginary plane IP, namely, the opening of the groove 241 only faces the interspace between the shaft 11 and the outlet surface 212. Therefore, the air flowing to the groove will produce turbulence. The turbulence forms an air wall between the groove 241 and the adjacent outer edge of the blades 12 so as to effectively reduce the space which the air passes between the tongue structure and the outer edge of the blades in the flow channel, and then the noise is significantly reduced. On the other side, on the condition of producing the same level noise, the rotational speed of the fan F in the embodiment is further increased so as to raise the volume flow rate.

Figure 2A:
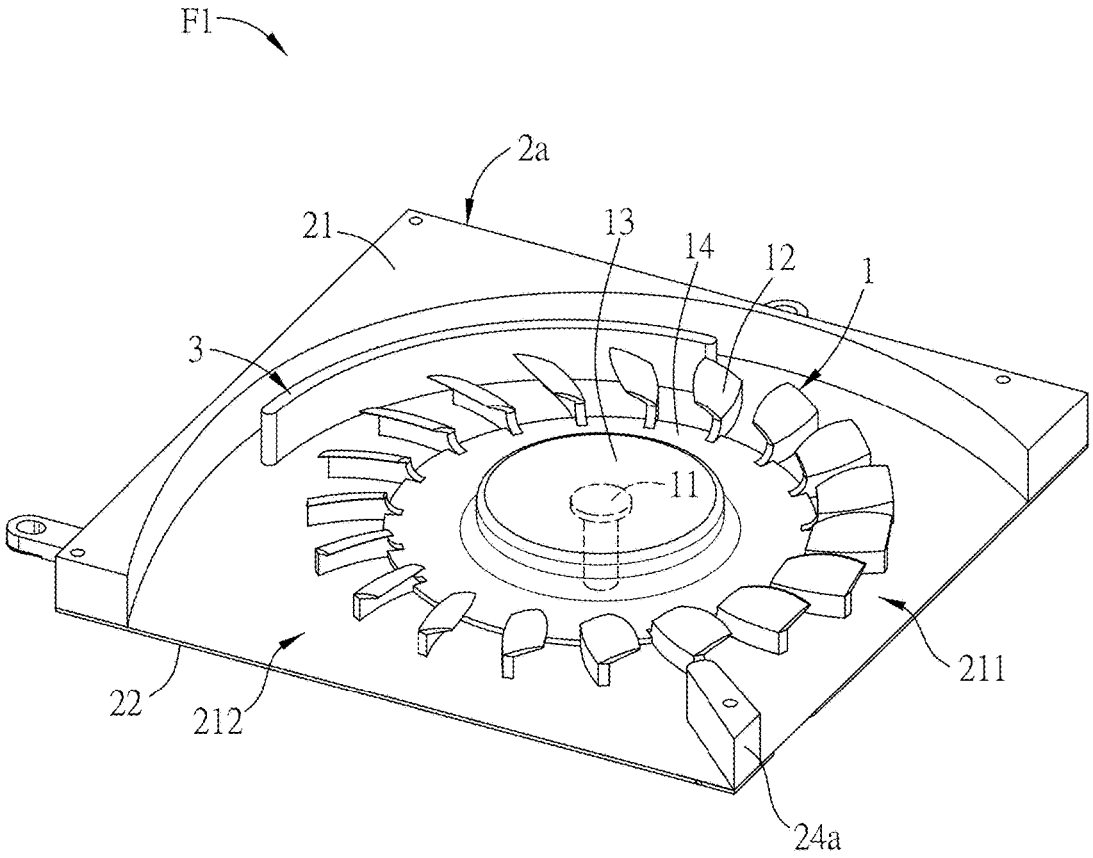
FIG. 2A is a partial perspective view showing a fan according to the second embodiment of the invention.
Figure 2B:
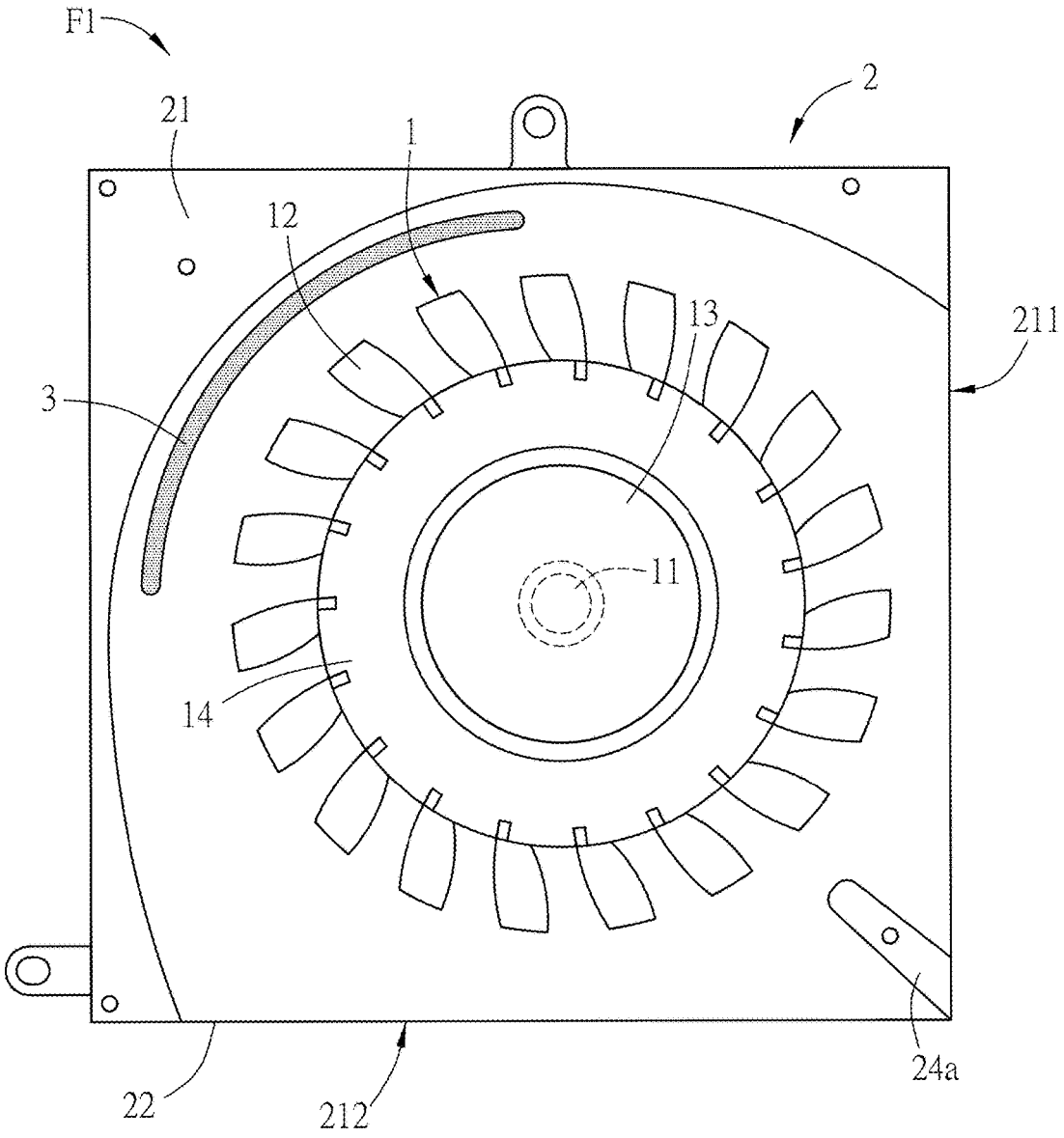
FIG. 2B is a top view showing the fan of FIG. 2A.

FIG. 2A is a partial perspective view showing a fan according to the second embodiment of the invention. FIG. 2B is a top view showing the fan of FIG. 2A. Referring to FIG. 2A and FIG. 2B, in the embodiment, the fan F1 includes the rotor 1, the fan frame 2*a* and a partition structure 3. The rotor 1 is disposed within the fan frame 2*a*, and it includes a shaft 11, a plurality of blades 12, a hub 13 and a disk structure 14. Because the connection relationship of the rotor 1 is illustrated in the previous embodiment, it is not repeated here again.

The fan frame 2*a* has a frame wall 21, a base 22, a cover 23 and a tongue structure 24*a*. Because the fan frame 2*a* is approximately the same with or similar to the fan frame 2, the elements and their connection relationships can be referred to the illustration of the previous embodiment. Thus, they are not repeated here again. Besides, the tongue structure 24*a* may has a groove structure as shown in FIG. 1A, alternatively it may not has a groove structure as shown in FIG. 2A.

The partition structure 3 is disposed between the blades 12 and the inner wall surface of the frame wall 21. In the embodiment, the partition structure 3 is arc-shaped and it is disposed on the base 22. The partition structure 3 divides the flow channel into an inner flow channel and an outer flow channel. The outer flow channel is located between the partition structure 3 and the inner wall surface of the frame wall 21. The inner flow channel is located between the partition structure 3 and the blades 12. Therefore, when the rotor 1 rotates and the blades 12 accordingly drive the air to enter the outer flow channel and the inner flow channel from the inlet surface 211, partial air flow flowing into the inner flow channel is reflected by the partition structure 3 and then enters the rotation range of the blades 12 again. Thus, the detained air in the fan F1 can be reduced and the effective outlet volume flow rate is raised. On the other side, the partition structure 3 can disperse the flow field at the end of the blades 12 so as to prevent reflux like conventional fan resulting from too much fluid following the end of the blade.

In addition, the height of the partition structure 3 being higher than or equal to half the height of the frame wall 21 will be effective. In one embodiment, it is illustrated that the height of the partition structure 3 is equal to half the height of the frame wall 21, and the partition structure 3 is connected with the base 22 and the cover 23. In other embodiments, the height of the partition structure 3 equal to half the height of the frame wall 21, or it is between half the height of the frame wall 21 and the height of the frame wall 21 so as to similarly reduce the detained air in the fan and then raise the effective outlet volume flow rate. Besides, the partition structure 3 can be connected with the base 22, or it can be connected with the cover 23, or partition structures 3 can be respectively disposed on the base 22 and the cover 23. Similarly, it can reduce the detained air in the fan and then raise the effective outlet volume flow rate.

Figure 3:
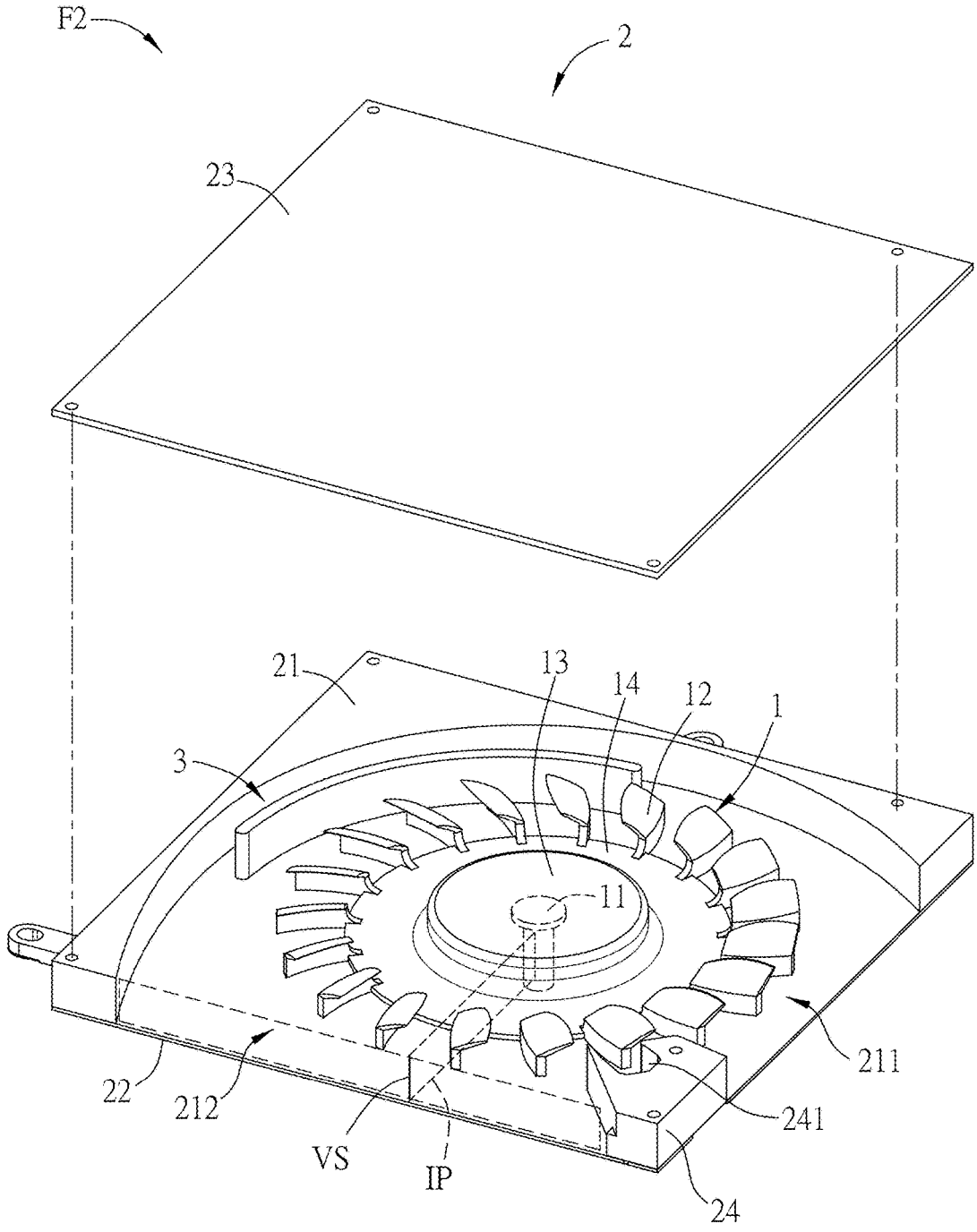
FIG. 3 is a perspective view showing a fan according to the third embodiment of the invention.

FIG. 3 is a perspective view showing a fan according to the third embodiment of the invention. Referring to FIG. 3, in the embodiment, the fan F2 includes the rotor 1, the fan frame 2*a* and a partition structure 3. The tongue structure 24 has a groove 241, namely the current embodiment is the combination of the first embodiment and the second embodiment previously mentioned. Because the elements and descriptions have been illustrated above, they are not repeated here again. Therefore, because the fan F2 in the embodiment utilizes the tongue structure 24 having the groove 241, it can significantly reduce the noise, or further increase the rotational speed of the fan F2 so as to effectively raise the volume flow rate on the condition of producing the same level noise. Meanwhile, due to the partition structure 3, the detained air in the fan can be reduced and the effective outlet volume flow rate is enhanced.

Figure 4A:
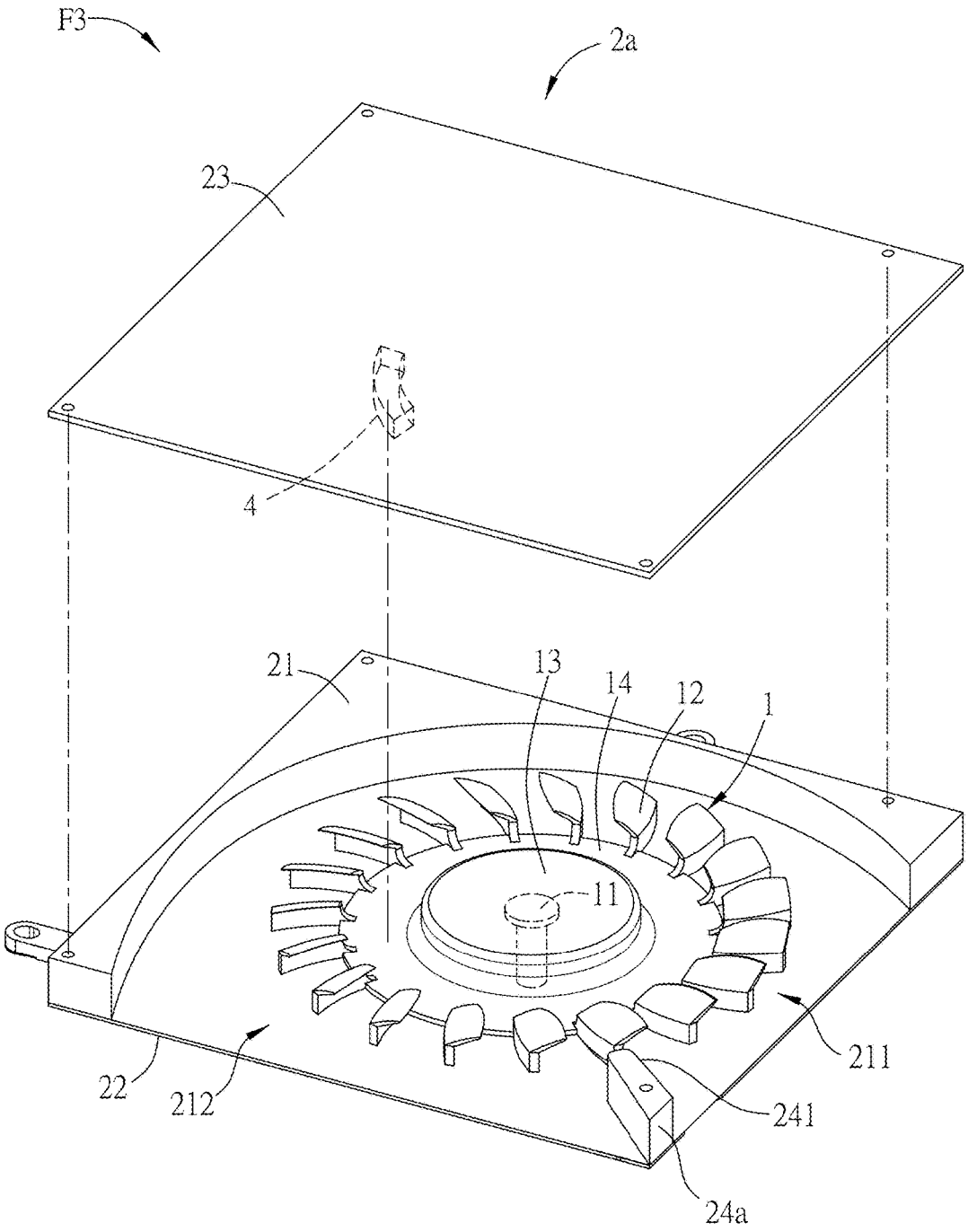
FIG. 4A is a perspective view showing a fan according to the fourth embodiment of the invention.

FIG. 4A is a perspective view showing a fan according to the fourth embodiment of the invention. Referring to FIG. 4A, the fan F3 includes the rotor 1, the fan frame 2*a* and a flow block structure 4. Because the rotor 1 and the fan frame 2*a* can be referred to those previously illustrated in the second embodiment, only the flow block structure 4 is specially explained below.

Figure 4B:
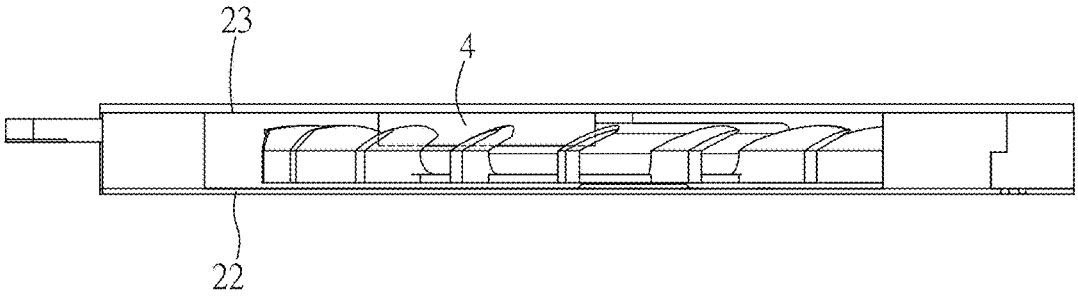
FIG. 4B and FIG. 4C are side views showing other varied embodiments of FIG. 4A.
Figure 4C:
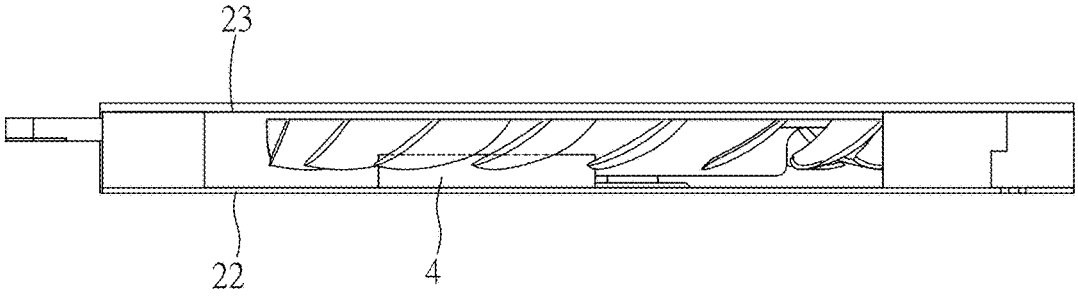

The flow block structure 4 is disposed between inlet surface 211 and the shaft 11. Namely, it may be disposed above (FIG. 4B) or under (FIG. 4C) the disk structure 14. In one embodiment, the flow block structure 4 is connected with the cover 23, the height of the flow block structure 4 is larger than or equal to half the distance between the cover 23 and the disk structure 14, and the height is smaller than the distance between the cover 23 and the disk structure 14. Therefore, after the air forms the air flow as the rotor 1 rotates, the air flowing across the disk structure 14 is blocked by the flow block structure 4, and then it will flow to the blades 12 and then be taken to the outlet surface 212 by the blades 12. Thus, the detained air can be reduced and the effective outlet volume flow rate is enhanced. Besides, the ratio of the projected widths that the flow block structure 4 is projected onto the outlet surface 212 with respect to the projected widths that the flow block structure 4 is projected onto the inlet surface 211 is preferably smaller than 0.8. In addition, in other embodiments, the flow block structure 4 may be connected with the base 22 instead, the height of the flow block structure 4 is larger than or equal to half the distance between the base 22 and the disk structure 14, and the height is smaller than the distance between the base 22 and the disk structure 14.

Figure 5:
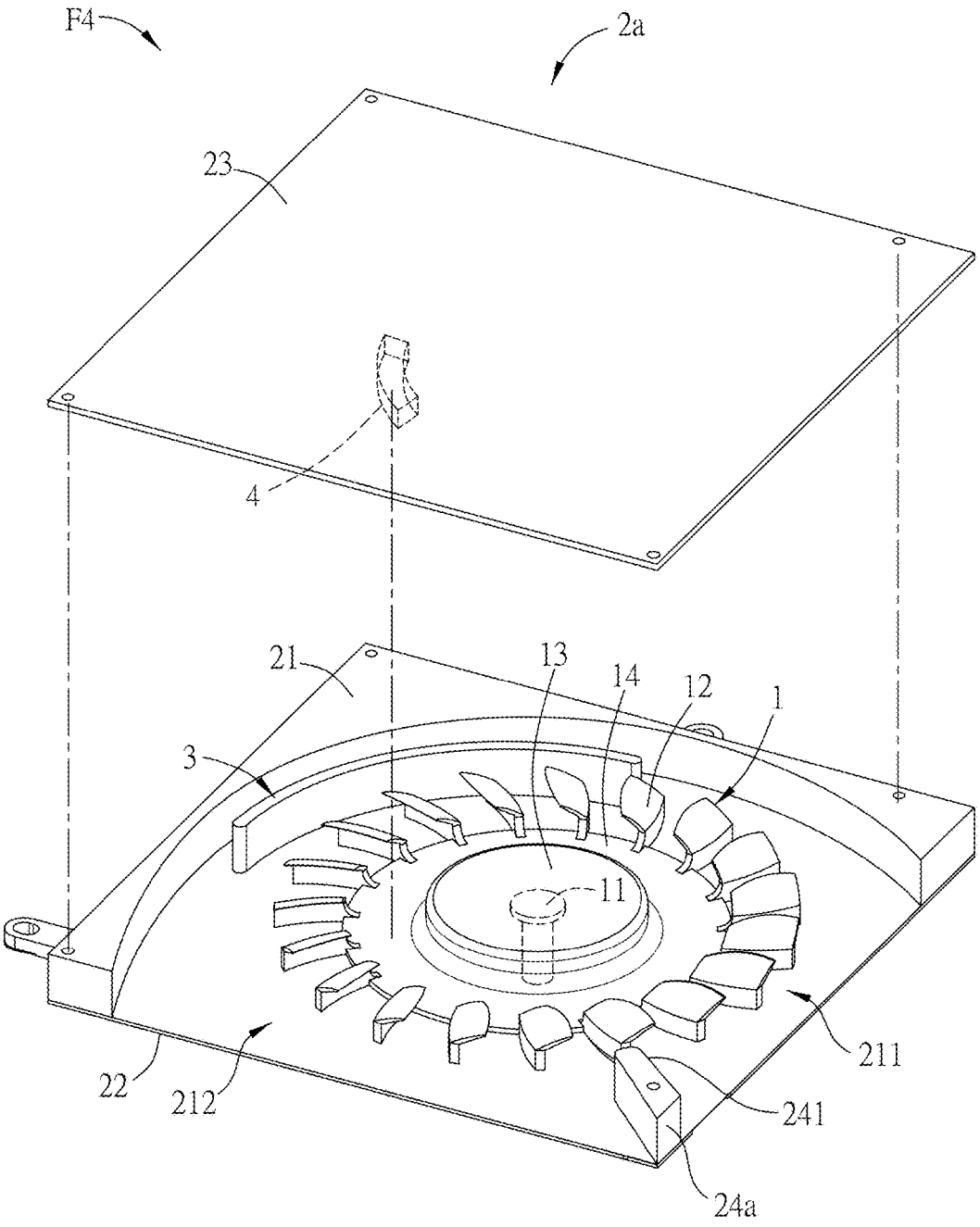
FIG. 5 is a perspective view showing a fan according to the fifth embodiment of the invention.
Figure 6:
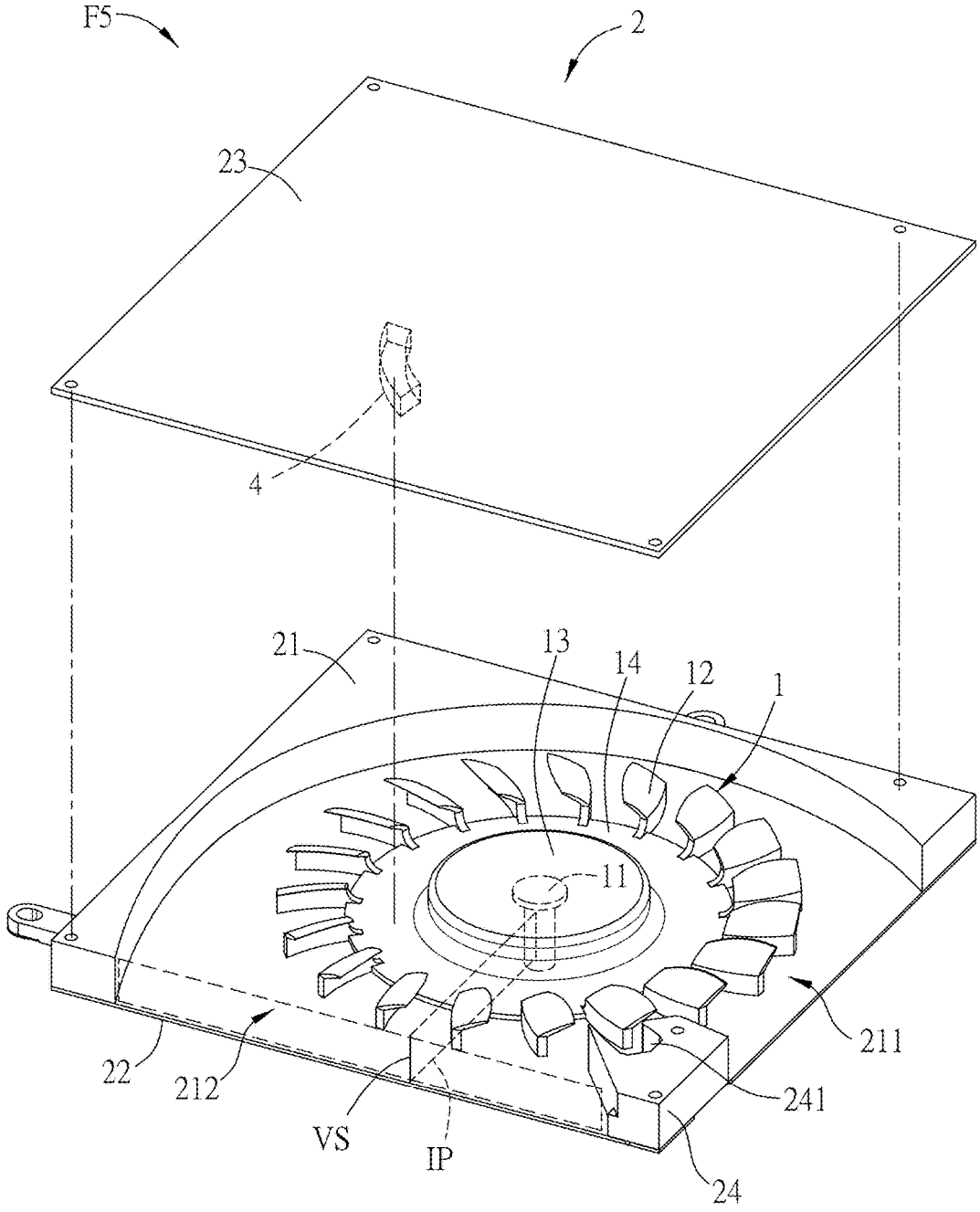
FIG. 6 is a perspective view showing a fan according to the sixth embodiment of the invention.

FIG. 5 is a perspective view showing a fan according to the fifth embodiment of the invention. Referring to FIG. 5, in the embodiment, the fan F4 includes the rotor 1, the fan frame 2*a*, the partition structure 3 and the flow block structure 4, namely, it is the combination of the second embodiment and the fourth embodiment mentioned above. Because the rotor 1, the fan frame 2*a*, the partition structure 3 and the flow block structure 4 are illustrated previously, they are not repeated here again. The fan F4 in the embodiment includes both the partition structure and the flow block structure, thus, when the rotor 1 rotates and the blades 12 accordingly drive the air to enter the outer flow channel and the inner flow channel from the inlet surface 211, partial air flow flowing into the inner flow channel is reflected by the partition structure 3 and then enters the rotation range of the blades 12 again. In the meanwhile, because the air flowing across the disk structure 14 is blocked by the flow block structure 4, it will flow to the blades 12 and then be taken to the outlet surface 212 by the blades 12. Thus, the detained air in the fan F1 can be reduced and the effective outlet volume flow rate is enhanced FIG. 6 is a perspective view showing a fan according to the sixth embodiment of the invention. Referring to FIG. 6, the fan F5 includes the rotor 1, the fan frame 2 and the flow block structure 4. The difference between the current embodiment and the fourth embodiment is that the tongue structure 24 of the fan F5 has the groove 241. Thus, the detained air can be reduced and the effective outlet volume flow rate is enhanced by the disposal of the flow block structure 4, and the noise is further reduced by the disposal of the groove 241. Alternatively, on the condition of producing the same level noise, the rotational speed of the fan F5 is further increased so as to raise the volume flow rate.

Figure 7:
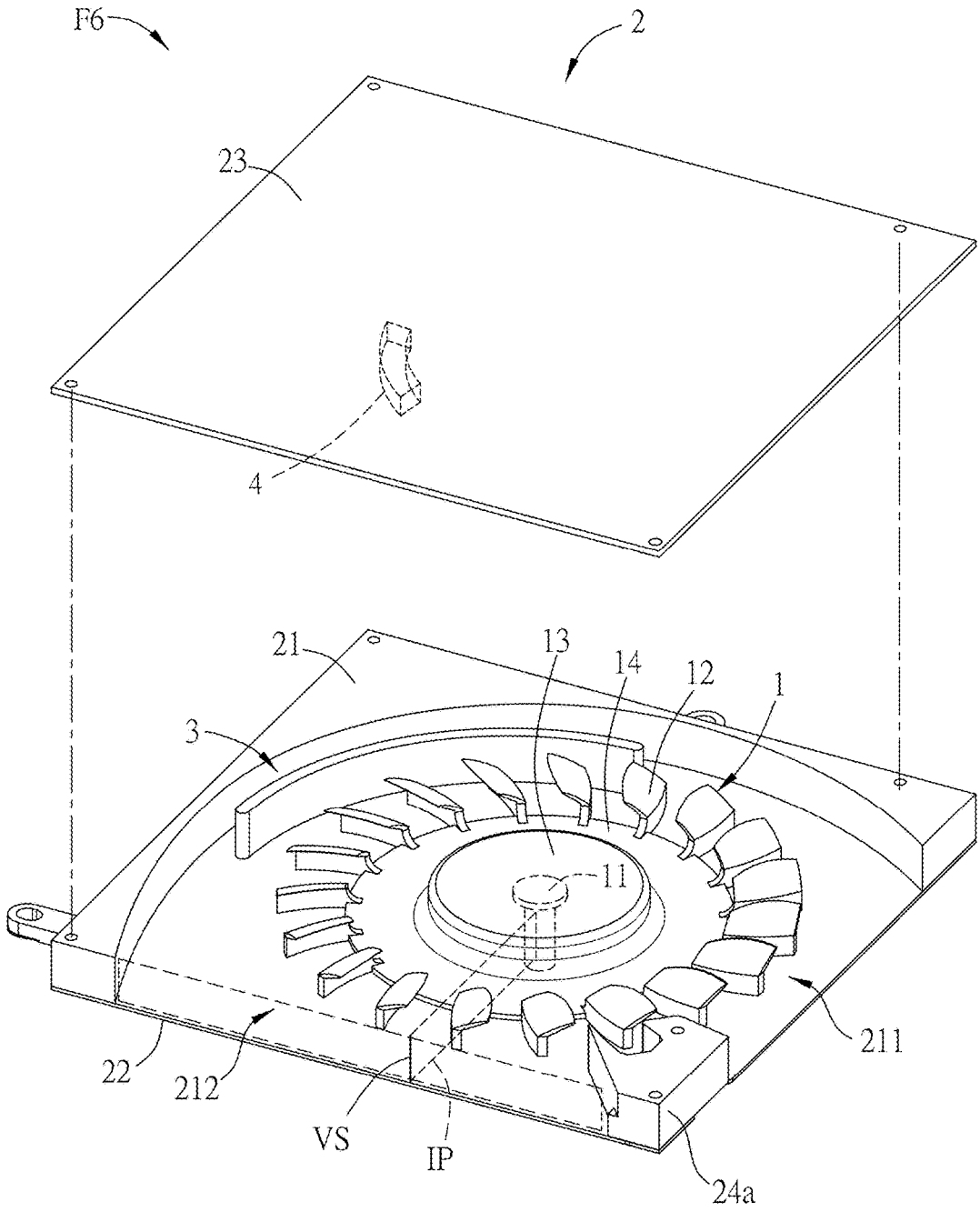
FIG. 7 is a perspective view showing a fan according to the seventh embodiment of the invention.

FIG. 7 is a perspective view showing a fan according to the seventh embodiment of the invention. Referring to FIG. 7, the fan F6 includes the rotor 1, the fan frame 2, the partition structure 3 and the flow block structure 4. In other words, the fan F6 has all the partition structure 3, the flow block structure 4 and the groove 241 of the tongue structure 24, thus, the detained air in the fan F6 can be further reduced, the effective outlet volume flow rate is enhanced, and the noise is reduced. Because the elements and their connection relationships of the fan F6 can be referred to the illustration of the previous embodiment, they are not repeated here again.

Figure 8:
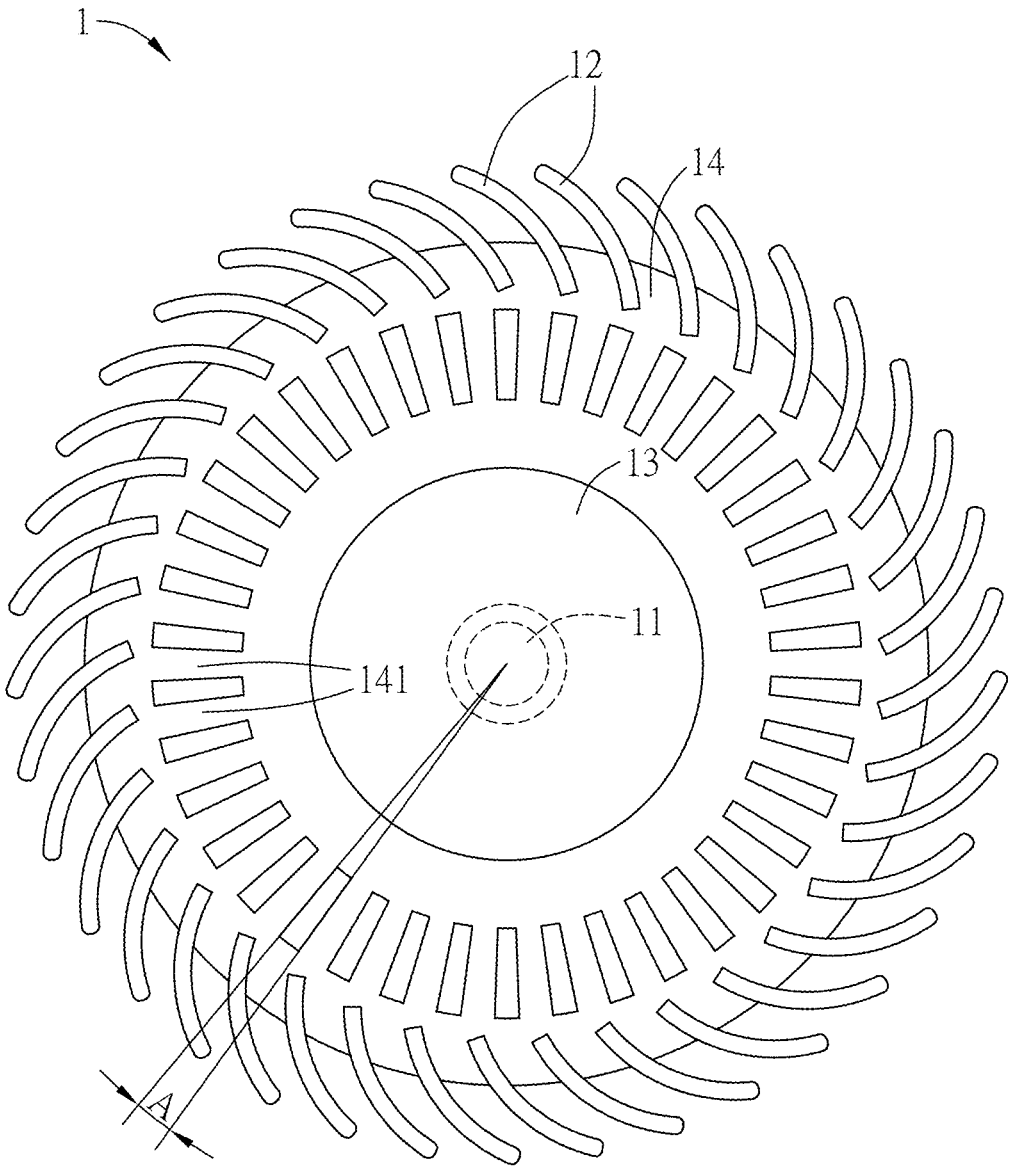
FIG. 8 is a top view of the rotor.

FIG. 8 is a top view of the rotor. Referring to FIG. 8, the rotor 1 in the above embodiments can be varied as following. For example, a plurality of ribs 141 can be formed within the disk structure 14, the intervals between the ribs 141 can ease wind shear effect so as to reduce the noise. In addition, an included angle A exists between the extensions of the adjacent ribs 141, and the angle A is preferably between 9° to 18°. In other various embodiments, the extension of every rib 141 may not pass through the rotation center of the rotor 1. For example, they are arranged by being inclined at a constant angle.

In addition, the inclination angle of the blades 12 of the rotor 1 with respect to the shaft 11 may be between 5° to 50° so as to raise wind pressure.

As mentioned above, because the fan utilizes the design of the tongue structure having the groove, the air flowing to the groove will produce turbulence. Thus an air wall is formed between the groove and the adjacent outer edge of the blades so as to effectively reduce the space which the air passes between the tongue structure and the outer edge of the blades in the flow channel, and then the noise is significantly reduced. On the other side, on the condition of producing the same level noise, the rotational speed of the fan in the embodiment is further increased so as to raise the volume flow rate. In other embodiments, the fan may include the partition structure and the flow block structure. Thus, when the rotor rotates and the blades accordingly drive the air to enter the outer flow channel and the inner flow channel from the inlet surface, partial air flow flowing into the inner flow channel is reflected by the partition structure and then enters the rotation range of the blades again. In the meanwhile, because the air flowing across the disk structure is blocked by the flow block structure, it will flow to the blades and then be taken to the outlet surface. Thus, the detained air in the fan can be reduced and the effective outlet volume flow rate is enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A cross flow fan, comprising:

a rotor, having a shaft, a plurality of blades, a hub and a disk structure, wherein the disk structure is connected with the blades and the hub, and the shaft is connected to the hub and located at the rotation center of the hub; and a fan frame, the rotor being disposed within the fan frame, the fan frame of the cross flow fan having:

a frame wall, having a lateral flow inlet to the rotor and a lateral flow outlet from the rotor, wherein a normal line of the lateral flow inlet and a normal line of the lateral flow outlet are not parallel to an extension direction of the shaft, and the blades directly face the lateral flow inlet and the lateral flow outlet along radial directions of the shaft;

a base, carrying the rotor and the frame wall;

a cover, disposed on one side of the frame wall opposite to the base; and a tongue structure, disposed between the base and the cover and having a groove, wherein the groove extends from the cover to the base, and an axial depth of the groove is smaller than or equal to a height of the tongue structure;

wherein a vertical distance between the base and the cover is smaller than a diameter of the disk structure of the rotor;

wherein the lateral flow outlet has a virtual line segment, the distance between the virtual line segment and the shaft is the shortest distance between the shaft and the lateral flow outlet;

wherein the virtual line segment and the shaft are located on an imaginary plane, and an extended line from a center of an opening of the groove intersects the imaginary plane.

2. The cross flow fan of claim 1, wherein an inclination angle of the blades with respect to the shaft is between 5° to 50°.

3. The cross flow fan of claim 1, wherein a plurality of ribs are formed within the disk structure, and an included angle between extension directions of the adjacent ribs is between 9° to 18°.

4. The cross flow fan of claim 1, wherein a width of the lateral flow inlet is wider than a width of the lateral flow outlet.

5. The cross flow fan of claim 1, wherein an air flow into the groove of the tongue structure produces a turbulence forming an air wall between the groove and adjacent outer edges of the blades so as to reduce a space through which the air passes between the tongue structure and the adjacent outer edges of the blades.

6. The cross flow fan of claim 1, wherein the groove is defined by side walls of the tongue structure.

* * * * *